US008316808B2

(12) United States Patent
Reuter et al.

(10) Patent No.: US 8,316,808 B2
(45) Date of Patent: Nov. 27, 2012

(54) CONTROL TIME ADJUSTING DEVICE

(75) Inventors: Bernd Reuter, Schwaig (DE); Rainer Ottersbach, Aurachtal (DE); Michael Weiss, Aachen (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 284 days.

(21) Appl. No.: 12/674,489

(22) PCT Filed: Jul. 30, 2008

(86) PCT No.: PCT/EP2008/059994

§ 371 (c)(1),
(2), (4) Date: May 7, 2010

(87) PCT Pub. No.: WO2009/024440

PCT Pub. Date: Feb. 26, 2009

(65) Prior Publication Data

US 2010/0218737 A1 Sep. 2, 2010

(30) Foreign Application Priority Data

Aug. 23, 2007 (DE) ..... 10 2007 039 852

(51) Int. Cl.
*F01L 1/34* (2006.01)

(52) U.S. Cl. ..... 123/90.17; 123/90.15; 123/90.31

(58) Field of Classification Search ..... 123/90.15, 123/90.17, 90.31
See application file for complete search history.

(56) References Cited

U.S. PATENT DOCUMENTS 6,283,075 B1 * 9/2001 Schafer et al. ..... 123/90.17
2003/0070639 A1 4/2003 Kohrs

FOREIGN PATENT DOCUMENTS

WO 2005/121511 A 12/2005

* cited by examiner

*Primary Examiner* — Zelalem Eshete
(74) *Attorney, Agent, or Firm* — Lucas & Mercanti, LLP; Klaus P. Stoffel

(57) ABSTRACT

A control time adjusting device which adjusts the phase position of a camshaft with respect to an upstream drivetrain that drives the camshaft. The device has a hub element and a bell element which is coupled to the hub element in a variably adjustable manner with regard to the rotary phase position. The adjusting angle range is defined by stop structures. Additionally, adjusting cells, which are separated by radial webs and vane elements, are situated in an intermediate space between the hub element and bell element. The position and the peripheral length of the device, which is definitive for the pivoting travel of the adjusting cells and the arrangement of the vane elements with respect to one another, are adapted such that at least two different-sized adjusting angle ranges can be defined as a function of the assignment of the vane elements to the adjusting cells.

12 Claims, 4 Drawing Sheets

Illustration with number of vane elements n = 5

Illustration with number of vane elements n = 5

CONTROL TIME ADJUSTING DEVICE

This application is a 371 of PCT/EP2008/059994 filed Jul. 30, 2008, which in turn claims the priority of DE 10 2007 039 852.4 filed Aug. 23, 2007, the priority of both applications is hereby claimed and both applications are incorporated by reference herein.

FIELD OF THE INVENTION

The invention relates to a timing adjustment device which serves as such for setting the phase position of a camshaft with respect to the drive train which is provided for driving the latter and is mounted upstream thereof. This timing adjustment device comprises a hub element which, in the installation position, is coupled to the camshaft, and a bell element which, in terms of the rotary phase position, is coupled in a variably adjustable manner to the hub element, wherein the adjustment angle range within which the hub element is pivotable with respect to the bell element about an actuating axis, which is concentric with respect to the camshaft axis, is defined by stop structures.

U.S. 2003/0070639 A1 discloses a timing adjustment device of the abovementioned type. This timing adjustment device comprises a plurality of adjusting cells which are actuated by means of a switching valve mechanism and which are located in an intermediate space defined between the hub element and the bell element, and are separated from one another by radial webs. Vane elements which divide the respective adjusting cells into a first and a second adjusting chamber section, in the manner of an actuating piston, are arranged in these adjusting cells. The supply of pressurized oil to the individual adjusting cells is provided via pressurized oil ducts which are formed as such in the region of the hub element and the end region of the camshaft which supports the latter. In this known timing adjustment device, the adjustment angle range is defined by the end walls of the adjusting cells which function as stop faces.

JP 2002-213262 has also disclosed a timing adjustment device for setting the phase position of a camshaft with respect to the camshaft drive train. This timing adjustment device also comprises a bell element with a plurality of adjusting cells which are formed in the interior region thereof. Vane elements, which are embodied so as to be integral with a hub element, dip into these adjusting cells.

The magnitude of the required adjustment angle which can be implemented by means of the abovementioned timing adjustment devices depends on numerous motor-engineering conditions. Typically, a larger adjustment angle is required for timing adjustment devices which are provided for changing the timings of an inlet valve camshaft than for timing adjustment devices which are provided for outlet valve camshafts.

OBJECT OF THE INVENTION

The invention is based on the object of specifying solutions which provide advantages for making available advantageously coordinated timing adjustment devices in terms of technical production criteria.

INVENTIVE SOLUTION

The object specified above is achieved according to the invention by means of a timing adjustment device for setting the phase position of a camshaft within a camshaft drive train, having:

a hub element, a bell element which, in terms of the rotary phase position, is coupled in a variably adjustable manner to the hub element, wherein the adjustment angle range, within which the rotary phase position of the hub element is pivotable with respect to the bell element, is defined by stop structures, a plurality of adjusting cells which are located in an intermediate space defined between the hub element and the bell element and are separated from one another by radial webs, and vane elements which each dip in the radial direction into one of the assigned adjusting cells and divide the latter into a first and a second adjusting chamber section, wherein this timing adjustment device is distinguished in that the position and the circumferential length of the adjusting cells, which is decisive for the pivoting distance, and the arrangement of the vane elements are matched to one another in such a way that at least two adjustment angle ranges of different magnitudes can be defined as a function of the assignment of the vane elements to the adjusting cells.

As a result, it becomes advantageously possible for the maximum adjustment angle range which can be implemented by means of this timing adjustment device to be defined, only directly when the timing adjustment device is assembled, through adequate insertion of the hub element into the bell element.

On the basis of the concept according to the invention it therefore becomes possible to provide, through structurally identical components, timing adjustment devices which are suitable both for the connection to an inlet valve camshaft and for the connection to an outlet valve camshaft, and nevertheless provide different maximum adjustment set angles which are bounded by an internal stop.

According to one particularly preferred embodiment of the invention, the radial webs are formed in the bell element, and the vane elements are anchored in the hub element. The radial webs may be formed here directly by structures which are fabricated integrally with the bell element.

The vane elements are preferably configured in such a way that their wall thicknesses measured in the circumferential direction are essentially the same. These vane elements can either be embodied so as to be integral with the hub element or may, if appropriate, be inserted in such a way that they can slide slightly in corresponding driver slots in the hub element. The vane elements are preferably provided with sealing elements in the region of the movement gaps bordering said vane elements.

The inventive concept for permitting at least two different maximum adjustment angle ranges of a timing adjustment device can be implemented, in particular, by virtue of the fact that the circumferential lengths of the adjusting cells are essentially of equal magnitude, but these adjusting cells and/or the assigned vane elements are arranged with non-uniform pitches on the hub element.

The timing adjustment device according to the invention is preferably configured in such a way that said device can be used both for an inlet valve camshaft and for an outlet valve camshaft, wherein the bell element and the hub element are embodied in such a way that an optimum maximum adjusting range, which is provided for the inlet valve camshaft or for the outlet valve camshaft, can be defined as a function of the insertion of the hub element into the bell element. The timing adjustment device may be embodied here in such a way that, in a first joined configuration, the adjusting range is approximately 25°, and in the second joined configuration the adjusting range is approximately 31°. In particular in the case of the abovementioned adjustment angle ranges it is possible to configure the bell element in such a way that it forms five adjusting cells.

BRIEF DESCRIPTION OF THE FIGURES

Further details and features of the invention emerge from the following description in conjunction with the drawing, in which.

DETAILED DESCRIPTION OF THE FIGURES

Figure 1:
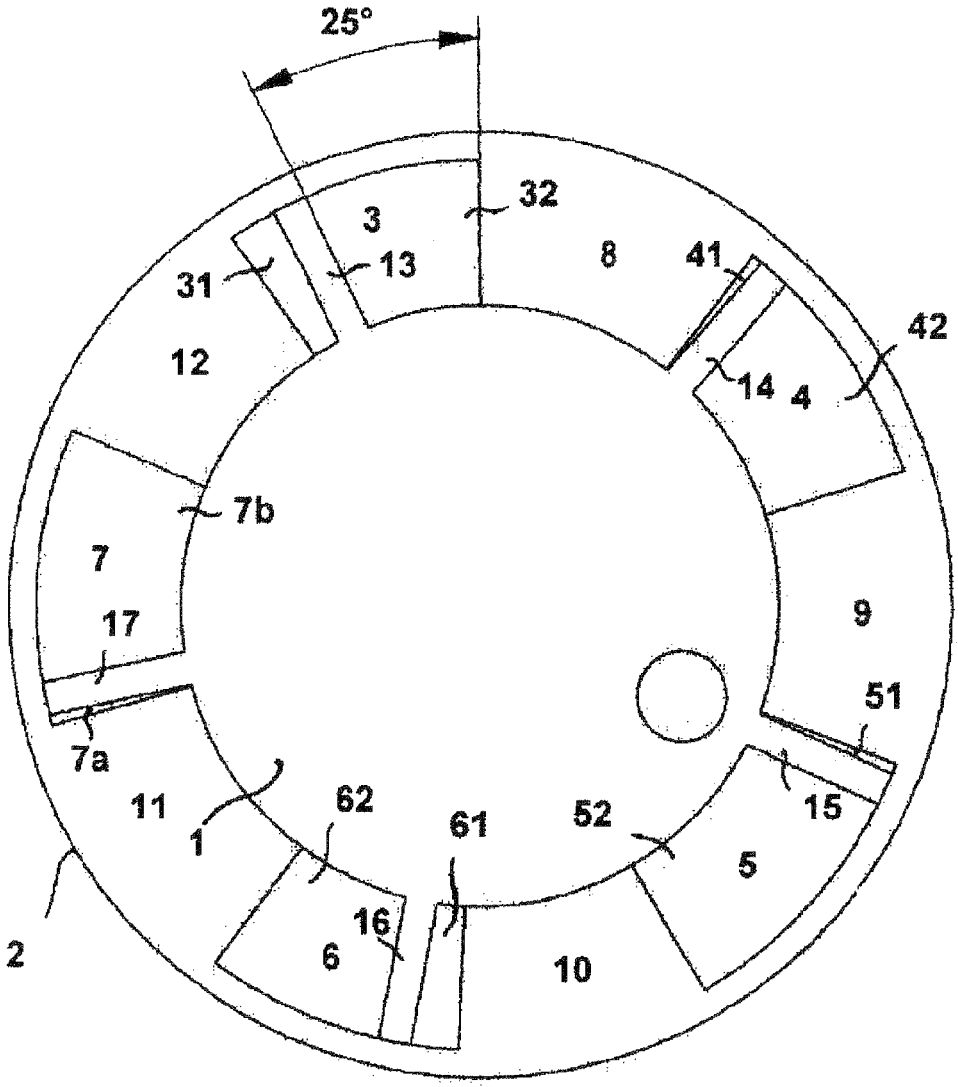
FIG. 1 shows a schematic illustration explaining the core concept of a timing adjustment device according to the invention in a configuration state in which a small adjustment angle range is provided.

The timing adjustment device, illustrated only schematically in FIG. 1 in terms of the design of the core components, serves as such to set the phase position of a camshaft with respect to the camshaft drive train which is provided for driving this camshaft. This timing adjustment device comprises a hub element 1 which, in the installation position, is coupled to a camshaft. The timing adjustment device also comprises a bell element 2 which, in terms of its rotary phase position with respect to the hub element 1, is coupled to the latter in a variably adjustable fashion.

The timing adjustment device comprises a plurality of adjusting cells 3, 4, 5, 6, 7 which are located in an intermediate space defined between the hub element 1 and the bell element 2 and are separated from one another by radial webs 8, 9, 10, 11, 12.

Vane elements 13, 14, 15, 16, 17 dip into these adjusting cells 3, 4, 5, 6, 7 and divide the adjusting chambers into, in each case, a first and a second adjusting chamber section 31, 32, 41, 42, 51, 52, 61, 62, 71, 72. The adjustment angle range within which the rotary phase position of the two components 1, 2 can be changed with respect to one another is defined by end walls of the adjusting cells 3, 4, 5, 6, 7 which partially function as stop faces.

The timing adjustment device illustrated here is distinguished in that the position and the circumferential length, which is decisive for the freedom of movement of the vane elements 13, 14, 15, 16, 17, of the respective adjusting cells 3, 4, 5, 6, 7 and the arrangement of the vane elements 13, 14, 15, 16, 17 on the hub element 1 are matched to one another in such a way that at least two adjustment angle ranges of different magnitude can be defined as a function of the assignment of the vane elements 13, 14, 15, 16, 17 to the adjusting cells 3, 4, 5, 6, 7.

According to the invention, the vane elements 13, 14, 15, 16, 17 are only assigned to the respective adjusting chambers 3, 4, 5, 6, 7 within the context of the process of assembling the timing adjustment device. On the basis of the inventive concept it is therefore possible, as already stated, to provide, from completely structurally identical main components, timing adjustment devices which differ in terms of the maximum adjustment angle which can be brought about thereby.

Pressurized oil can be applied to the first and second adjusting chamber sections 31, 32, 41, 42, 51, 52, 61, 62, 71, 72 in a manner known per se. In this regard, reference is made in particular to U.S. 2003/0070639 A1 which is cited at the beginning and which is tracing back to the applicant.

In the configuration of the timing adjustment device which is shown here in FIG. 1, the illustrated final set state is defined by the abutment of the vanes 14, 15 and 17 against the end faces, facing the latter, of the radial webs 8, 9 and 11. When the hub element 1 is rotated back with respect to the bell element 2, the end position which can be reached in the process is defined by the abutment of the vane elements 13, 14 and 16 against the end faces, facing the latter, of the radial webs 8, 9 and 11.

Figure 2:
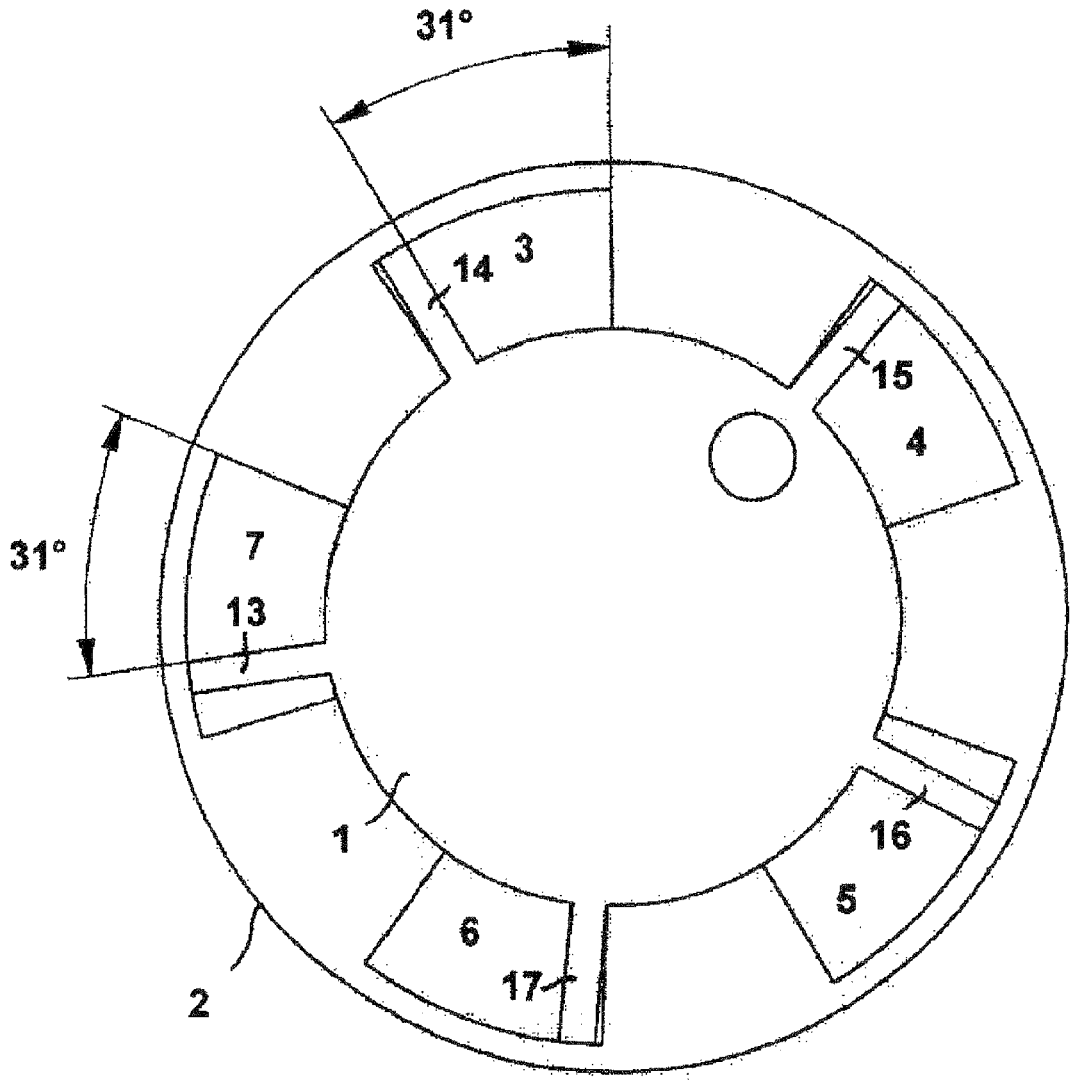
FIG. 2 also shows a schematic illustration, similar to FIG. 1, but illustrating a configuration state which provides a larger adjusting range.

FIG. 2 illustrates a timing adjustment device in a configuration state in which, by using the same components as in the timing adjustment device according to FIG. 1, an adjustment angle range for the rotation of the hub element 1 with respect to the bell element 2 can be achieved which is approximately 6 degrees greater than with the configuration form according to FIG. 1. In the configuration state shown here, the vane element 13 is assigned to the adjusting cell 7. Accordingly, the vane elements 14, 15, 16, 17 are assigned to the adjusting cells 3, 4, 5 and 6. In this configuration state, the vane elements 14, 15 and 17 act as stop structures which define the rotation state (shown here) of the hub element 1 with respect to the bell element 2. When the hub element 1 is rotated back with respect to the bell element 2, a larger possible rotational angle range than with the configuration state according to FIG. 1 occurs.

In the timing adjustment device according to the invention according to FIGS. 1 and 2, both the hub element 1 which functions as a rotor and the bell element 2 which functions as a stator are embodied so as to be "asymmetrical".

It is possible to configure the hub element 1 and the bell element 2 in such a way that, depending on the number of adjusting cells 3, 4, 5, 6, 7, different configuration states are possible, wherein these configuration states respectively differ in terms of the adjustment angle range which is possible here. Owing to this approach it becomes possible to use structurally identical initial components to implement, in a relatively finely graduated fashion, a large number of timing adjustment devices which are different in terms of the adjusting range which can be achieved thereby.

Figure 3:
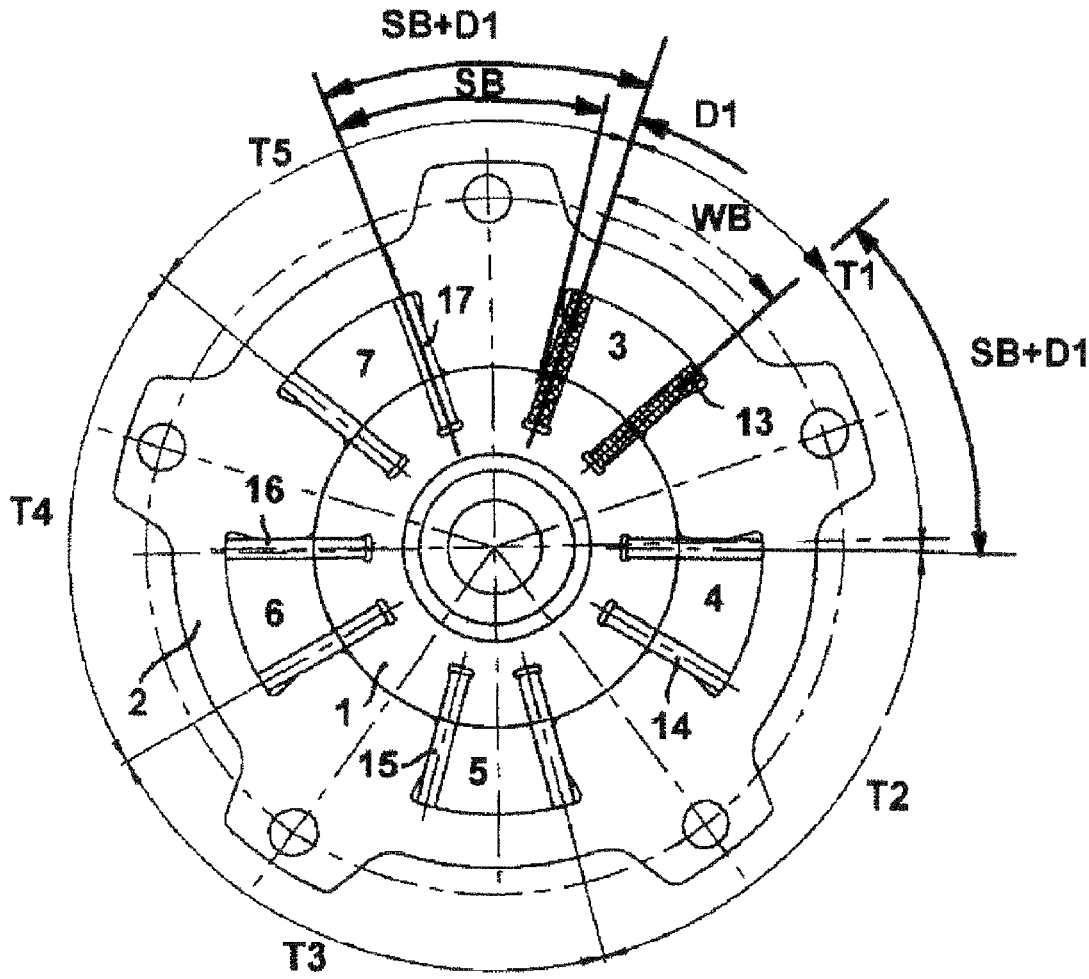
FIG. 3 shows a schematic illustration explaining a further variant of a timing adjustment device according to the invention in a first configuration state which provides as such the largest possible adjustment angle range.

FIG. 3 also illustrates in a highly simplified fashion a timing adjustment device in a configuration state which permits the largest possible adjustment angle for a rotation of the hub element 1 with respect to the bell element 2. In this configuration state, the hub element including the vane elements 13, 14, 15, 16, 17 which are supported thereby are presented both in the rotational position in which they are rotated forward to the maximum degree and in the initial rotational position merely for the sake of illustration. However, it is actually the case that only one vane element 13, 14, 15, 16, 17 is seated in each adjusting cell 3, 4, 5, 6, 7.

Figure 4:
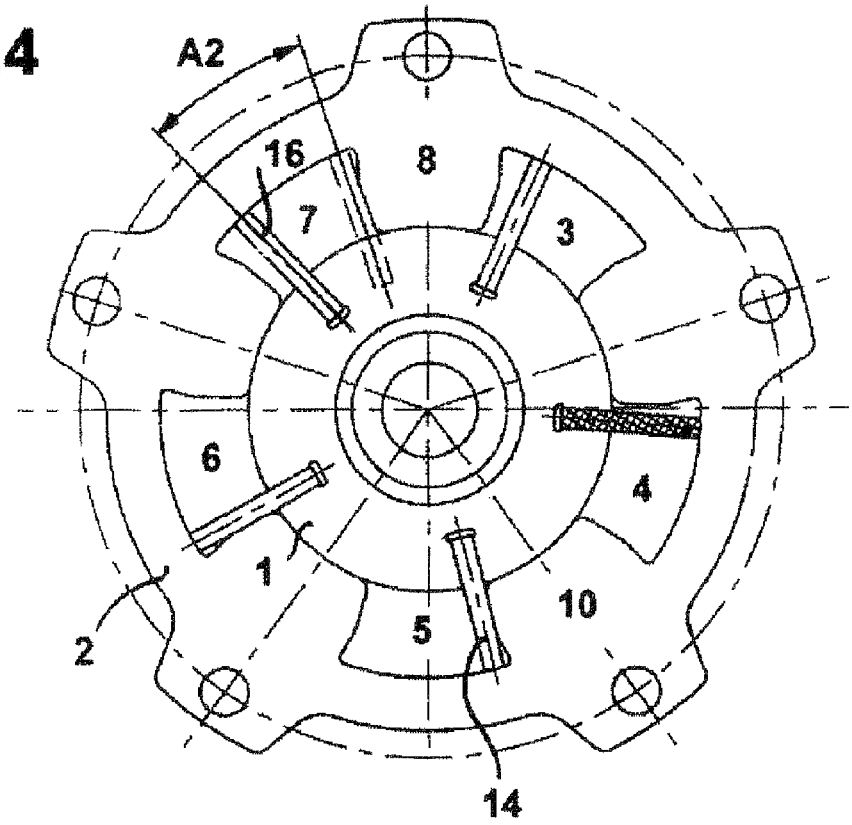
FIG. 4 shows a schematic illustration showing a configuration state which provides a somewhat smaller adjustment angle range.

In FIG. 4, the timing adjustment device which is composed of the same components as the exemplary embodiment according to FIG. 3 is illustrated in a configuration state in which the stop-bounded rotational angle of the hub element 1 which is possible here with respect to the bell element 2 is smaller than in the configuration state according to FIG. 3. The end position shown here for the rotation of the hub element 1 with respect to the bell element 2 is defined by the abutment of the vane element 14 against the end wall, facing the latter, of the radial web 10. When the hub element 1 rotates back with respect to the bell element 2, the end position which can be reached here is defined by the abutment of the vane element 16 against the end wall, facing the latter, of the radial web 8.

Figure 5:
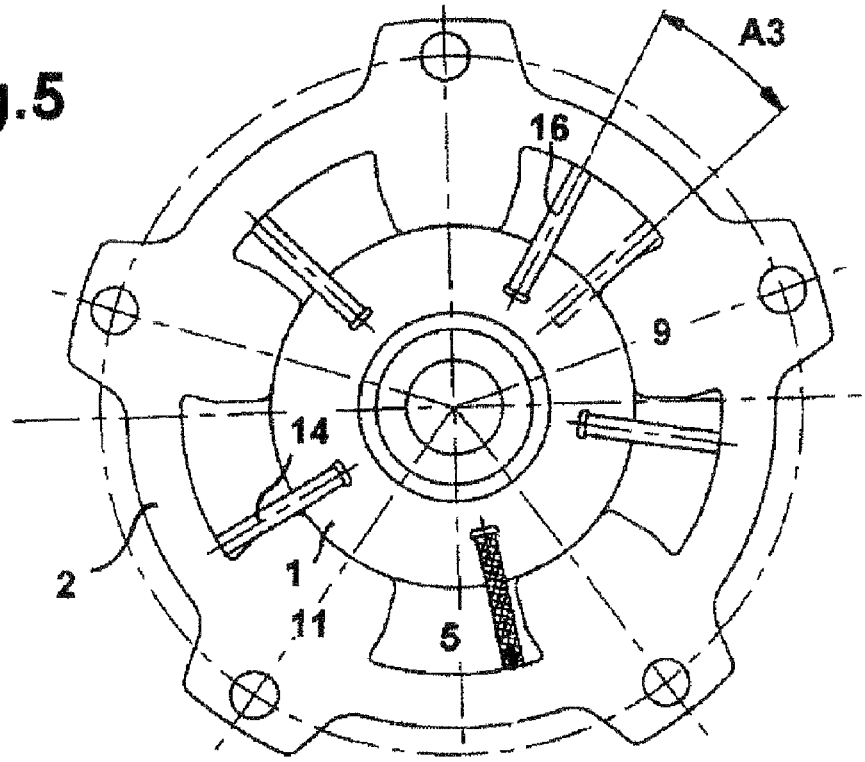
FIG. 5 shows a further schematic illustration showing a configuration state which provides as such an even smaller adjustment angle range.

FIG. 5 illustrates the inventive timing adjustment device in a third configuration state in which the adjustment angle range within which the hub element 1 can be rotated with respect to the bell element 2 is even smaller than with the configuration state according to FIG. 4.

In this exemplary embodiment, the vane 13 is located in the adjusting cell or cell 5. This rotational position is defined here, in particular, by the abutment of the vane element 14 against the end wall, facing the latter, of the radial web 11. The end position of the hub element 1 with respect to the bell element 2 during the backward rotation is defined by the abutment of the vane element 16 against the end wall, facing the latter, of the radial web 9.

The underlying core concept of the timing adjustment device according to the invention is to depart from the equal pitch concept employed to date with respect to the bell element and the arrangement of the vane elements and to implement different mechanical stop positions and therefore adjustment angle limitations in accordance with angle-related assignment of the vanes of the hub element to the bell element.

The explanation below is based on the assumption that reference is made therein to a serial index "i". This serial index is a natural number in the range from 1 to n, where n corresponds to the number of adjustment vanes or else to the number of adjusting cells.

In the configuration, the stator base angle SB is preferably defined on the basis of a base adjustment angle WB. If a required gradation angle D(i) is then added to the abovementioned stator base angle SB, different stator angles S(i) are obtained where i=(1 . . . n) and n stands for the number of adjustment vanes. The sum of (i)×WB+S(1)+S(2) . . . +S(n)=360°.

The partial sum WB+S(i)=T(i), where T(i) represents the modified pitch angle. In order to implement the maximum adjustment angle, the modified angular pitch can be found equally on both the rotor and stator (hub element and bell element). Differently modified pitches at the rotor and stator are also conceivable.

In the basic position, the vane with the reference symbol (i+2) on the rotor engages in the cell with the reference symbol (i+12) of the stator. This assembly condition leads to the adjustment angle range WB(0). If, during assembly, the rotor and stator are then set off by an angular pitch with the result that the vane with the reference symbol (i+2) engages in the cell with the reference symbol (i+13), it is possible, given a suitable selection of the gradation angles D(I), to change the adjustment angle range between the mechanical stops to WB(1).

The same applies if the vane with the reference symbol (i+2) engages in the adjusting cell or cell with the reference symbol (i+14) etc., wherein up to n different assembly possibilities are therefore obtained.

In locking mechanisms which engage in a lid in the axial direction, the locking pin in the rotor correspondingly rotates along with the assembly rotation T(i), that is to say not equidistantly, and therefore in a way which is analogous with the outer flange bores. Angular assignment of the locking bore in the lid to the locking pin in the rotor can be brought about by dividing the tool for the lid in two as follows:

1. in a first fabrication step the locking geometry is generated on a round disk,
2. during the formation of the flange structure, the tool of the outer contour is rotated by the angle T(i) in the second fabrication step.

The flange structure and the rotor position in the stator are therefore matched to one another. The above-described angular assignment of the rotor and stator and the possibility of pairing different rotor and stator pitches in the way described above results in a very wide variety of adjustment angle limitations with a comparatively low number of rotor variants and stator variants. This permits the mechanical limitation of the maximum adjustment angle to be changed, even when a tool is present, by simply changing the assembly positions. Additional, new costly tools are therefore not necessary.

The concept according to the invention provides a high degree of freedom of configuration for the optimization of the valve drive and of the motor thermodynamics. The rotors/stators can be manufactured with near-series-production tools or series-production tools, that is to say under extremely economical conditions. This also provides considerable cost reduction potential during the prototype technical-release procedure and permits development times to be tightened up by using a time-saving fabrication technology and by virtue of the possibility of early testing of near-series-production parts.

The invention claimed is:

1. A timing adjustment device for setting a phase position of a camshaft with respect to a camshaft drive train section, comprising:

a hub element;

a bell element which, in terms of the rotary phase position, is coupled in a variably adjustable manner to the hub element, wherein an adjustment angle range within which the rotary phase position of the hub element is pivotable with respect to the bell element is defined by stop structures;

a plurality of adjusting cells which are located in an intermediate space defined between the hub element and the bell element and are separated from one another by radial webs; and vane elements which each dip in a radial direction into one of the adjusting cells which are assigned and divide the latter into a first and a second adjusting chamber section, wherein the position and a circumferential length of the adjusting cells and arrangement of the vane elements are matched to one another so that at least two adjustment angle ranges of different magnitudes are definable as a function of an assignment of the vane elements to the adjusting cells.

2. The timing adjustment device of claim 1, wherein the radial webs are anchored in the bell element, and the vane elements are anchored in the hub element.

3. The timing adjustment device of claim 1, wherein the vane elements each have identical wall thicknesses measured in a circumferential direction.

4. The timing adjustment device of claim 1, wherein the vane elements are integral with the hub element.

5. The timing adjustment device of claim 1, wherein the vane elements are inserted into cutouts which are formed in the hub element.

6. The timing adjustment device of claim 1, wherein the circumferential length of each of the adjusting cells are of equal magnitude.

7. The timing adjustment device of claim 1, wherein the adjusting cells are arranged with a non-uniform circumferential pitch.

8. The timing adjustment device of claim 1, wherein the vane elements are arranged with a non-uniform circumferential pitch.

9. The timing adjustment device of claim 1, wherein the timing adjustment device can be used both for an inlet valve camshaft and for an outlet valve camshaft, and in that the bell element and the hub element are embodied in such a way that a maximum adjusting range, which is provided for an inlet valve camshaft and for an outlet valve camshaft, can be defined as a function of an insertion of the hub element into the bell element.

10. The timing adjustment device of claim 1, wherein, in a first joined configuration, an adjusting range is approximately 25°, and in that, in a second joined configuration the adjusting range is 31°.

11. The timing adjustment device of claim 1, wherein five adjusting cells are formed in the bell element.

12. The timing adjustment device of claim 1, wherein in an installation position the hub element is coupled to the camshaft, and the bell element is coupled to a drive train section which is synchronized with an crankshaft of an assigned internal combustion engine with a transmission ratio of ½.

* * * * *